US012466592B2

(12) United States Patent
Perreault et al.

(10) Patent No.: US 12,466,592 B2
(45) Date of Patent: Nov. 11, 2025

(54) APPARATUS AND METHOD FOR WRAPPING AN ARTICLE

(71) Applicant: 9192-9281 QUEBEC INC., Dolbeau-Mistassini (CA)

(72) Inventors: Martin Perreault, Dolbeau-Mistassini (CA); Patrick Sasseville, Dolbeau-Mistassini (CA)

(73) Assignee: 9192-9281 QUEBEC INC. (CA)

( * ) Notice: Subject to any disclaimer, the term of this patent is extended or adjusted under 35 U.S.C. 154(b) by 20 days.

(21) Appl. No.: 18/532,535

(22) Filed: Dec. 7, 2023

(65) Prior Publication Data

US 2024/0190599 A1 Jun. 13, 2024

Related U.S. Application Data

(60) Provisional application No. 63/386,520, filed on Dec. 8, 2022.

(51) Int. Cl.

| | |
|---|---|
| ***B65B 11/00*** | (2006.01) |
| ***B65B 11/56*** | (2006.01) |
| ***B65B 51/02*** | (2006.01) |
| ***B65B 51/05*** | (2006.01) |

(52) U.S. Cl.
CPC ..... *B65B 11/56* (2013.01); *B65B 51/02* (2013.01); *B65B 51/05* (2013.01)

(58) Field of Classification Search
CPC ..... B65B 11/00; B65B 11/02; B65B 11/08; B65B 41/14
See application file for complete search history.

(56) References Cited

U.S. PATENT DOCUMENTS

| | | | |
|---|---|---|---|
| 2,858,657 | A | 11/1958 | Guthrie |
| 3,238,697 | A | 3/1966 | Zucker |
| 3,327,452 | A | 6/1967 | Cranston, Jr. et al. |
| 3,338,025 | A | 8/1967 | Harrison et al. |
| 3,469,368 | A | 9/1969 | Searcy et al. |

(Continued)

FOREIGN PATENT DOCUMENTS

| | | | |
|---|---|---|---|
| CA | 2936043 | A1 | 8/2015 |
| EP | 3787976 | B1 | 3/2021 |
| WO | 2012/153285 | A1 | 11/2012 |

*Primary Examiner* — Andrew M Tecco
(74) *Attorney, Agent, or Firm* — BARNES & THORNBURG LLP

(57) ABSTRACT

An apparatus for wrapping a substantially parallelepiped shaped article with a wrapper material web, the apparatus comprising: a wrapper applicator for positioning the wrapping material web in a wrapping configuration in which the wrapping material web is applied on upper and peripheral faces of the article; a fastening device for maintaining the wrapping material web in the wrapping configuration on the article; a backing member positioner for positioning a backing member between the wrapper material web and the article at a desired location along the article to allow one of fastening an overlying material web portion of the wrapping material web to an underlying material web portion of the wrapping material web extending under the overlying material web portion at the desired location, and fastening the wrapping material web to the backing member at the desired location. There is also provided a method for wrapping the article.

7 Claims, 13 Drawing Sheets

(56) References Cited

U.S. PATENT DOCUMENTS 3,499,263 A * 3/1970 Byrd ..... B65B 11/22 53/64
3,500,609 A * 3/1970 Gunyou ..... B65B 63/02 53/531
3,507,091 A 4/1970 Gillespie et al.
3,553,935 A 1/1971 Woods
3,707,064 A 12/1972 Mucka et al.
3,771,280 A 11/1973 Bechle
3,775,930 A 12/1973 Mercer et al.
3,792,563 A 2/1974 Mercer et al.
3,808,767 A 5/1974 Reid
3,928,097 A * 12/1975 Sauder ..... B32B 5/24 156/213
4,231,210 A 11/1980 Nagode
4,400,929 A 8/1983 Iwaki et al.
4,609,101 A 9/1986 Ullman
5,014,495 A 5/1991 Bolejack et al.
5,657,608 A 8/1997 Parviainen et al.
6,026,957 A 2/2000 Bauer et al.
6,138,438 A 10/2000 Michell et al.
6,279,295 B1 * 8/2001 Girard ..... B65B 11/02 53/66
6,460,314 B1 * 10/2002 Girard ..... B65B 11/02 53/66
8,534,033 B2 * 9/2013 Perreault ..... B65B 57/00 53/397
9,003,747 B2 * 4/2015 Cerf ..... B65B 49/08 53/442
11,034,471 B1 6/2021 Frisch
2002/0044857 A1 4/2002 Dekker
2002/0053183 A1 5/2002 Yuyama et al.
2002/0124529 A1 9/2002 van der Lely
2002/0134047 A1 9/2002 Girard et al.
2004/0216425 A1 11/2004 Morton et al.
2004/0243277 A1 12/2004 Bonnain et al.
2005/0132667 A1 6/2005 Macleod et al.
2005/0274089 A1 12/2005 Drolet
2006/0096244 A1 5/2006 Cere'
2006/0168911 A1 * 8/2006 Owen ..... B65B 51/05 53/411
2006/0277869 A1 12/2006 Drolet
2007/0176389 A1 8/2007 VanBelle et al.
2008/0236108 A1 10/2008 Parmley et al.
2010/0326018 A1 * 12/2010 Perreault ..... B65B 41/14 53/461
2011/0107725 A1 5/2011 Sperry et al.
2012/0085072 A1 4/2012 Deschenes
2013/0212982 A1 8/2013 Baumann
2013/0276409 A1 * 10/2013 Cerf ..... B65B 11/58 53/442
2016/0114328 A1 4/2016 Carney
2016/0279317 A1 9/2016 Gale et al.
2021/0380302 A1 12/2021 McGuire, Jr.
2022/0250776 A1 8/2022 Lelie et al.
2022/0380072 A1 * 12/2022 Brinkmeyer ..... B25J 15/04

* cited by examiner

APPARATUS AND METHOD FOR WRAPPING AN ARTICLE

CROSS-REFERENCE TO RELATED APPLICATIONS

This application claims priority under 35USC§ 119(e) of U.S. provisional patent application No. 63/386,520, filed Dec. 8, 2022. The disclosure set forth in the referenced application is incorporated herein by reference in its entirety.

TECHNICAL FIELD

The invention relates to an apparatus for wrapping an article such as a substantially parallelepiped shaped bundle, and to a method of wrapping such an article.

BACKGROUND

It is known to wrap or envelop articles having an essentially orthogonal form, such as bundles of lumber, pulp, plywood or chipboard, or a pile of any adequate type of articles, on five sides thereof by suitable wrapper material.

Different wrapping techniques and apparatuses may be used to wrap the article. In some cases, the wrapping can be done entirely manually by one or more operators. In other cases, some steps of the wrapping may be automated and some steps may be performed manually, and in yet other cases the wrapping can be performed substantially entirely automatically using a wrapping apparatus.

Typically, during the wrapping operation or after the article has been fully wrapped, the wrapper material is fastened to sides of the articles using one or more fasteners such as staples or the like. In some instances, some portions of the wrapper material may be folded over underlying portions of the wrapper material during the wrapping operation. The fasteners can be positioned so as to also secure the folded portions and underlying portions of wrapping material together. This substantially prevents movement of the wrapping material relative to the article and/or maintains the wrapping material in its folded configuration on the article.

Unfortunately, in some cases, it may not be possible, practical or desirable to have fasteners penetrate the article. In some cases, the fasteners could be positioned over gaps, cavities or recesses of the article that would prevent the fasteners from penetrating the article through the wrapper material. For example, the article could include open-web joists or I-joists and the wrapping material could extend between flanges of the joist across a gap between the flanges. In this situation, it may be desirable to fasten the wrapping material using fasteners located in the area between the flanges, but because of the gap between the flanges, the fasteners may not reach and penetrate the article beneath the wrapping material.

In other cases, it may also not be possible or desirable to use fasteners to penetrate the article. For example, if the article includes substantially fragile or brittle materials such as drywall panels, it may not be possible or desirable to fasten the wrapping material to the article using fasteners that penetrate the material.

In view of the above, there is a need for a wrapping apparatus and a wrapping method, which would be able to overcome or at least minimize some of the above-discussed prior art concerns.

SUMMARY

According to one aspect, there is provided an apparatus for wrapping a substantially parallelepiped shaped article with a wrapper material web. The apparatus comprises: a wrapper applicator configured to position the wrapping material web in a wrapping configuration in which the wrapping material web is applied at least on upper and peripheral faces of the article; a fastening device for maintaining the wrapping material web in the wrapping configuration on the article; a backing member positioner having a prehension unit and a positioner actuator for moving the prehension unit at a desired location along the article to position a backing member between the wrapper material web and the article at a desired location along the article to allow at least one of: fastening an overlying material web portion of the wrapping material web to an underlying material web portion of the wrapping material web extending under the overlying material web portion at the desired location, and fastening the wrapping material web to the backing member at the desired location.

In at least one embodiment, the wrapper applicator is configured for covering a first peripheral face of the article with a first wrapping material web section and for covering a second peripheral face of the article adjacent the first peripheral face with a second wrapping material web section extending beyond a first lateral edge between the first and the second peripheral faces, such that a third wrapping material web section extends beyond an upper edge of the second peripheral face, at least part of the second wrapping material web section forming the underlying material web portion, the wrapper applicator being further configured for folding the third wrapping material web section about the upper edge of the second peripheral face against the second peripheral face and partially over the underlying material web portion such that at least part of the third wrapping material web section forms the overlying material web portion, and wherein the backing member positioner is configured for positioning the backing member against the second peripheral face and substantially proximal to the first lateral edge.

In at least one embodiment, the backing member is elongated and is positionable so as to extend against the second peripheral face and substantially along the first lateral edge.

In at least one embodiment, the backing member positioner is configured to remove the backing member from the wrapper material web once the article has been wrapped with the wrapper material web.

In at least one embodiment, the fastening device comprises a stapling mechanism including a stapling head to secure the backing member to at least one of the wrapper material web and the article and the prehension unit of the backing member positioner is configured to release the backing member once secured.

In at least one embodiment, the backing member is securable to at least one of the wrapper material web and the article and detachable from the backing member positioner.

In at least one embodiment, the backing member includes first and second backing member segments, the first backing member segment being positionable proximal and parallel to the first lateral edge of the first peripheral face and the second backing member segment being positionable proximal a lower edge of the second peripheral face extending opposite the upper edge thereof.

In at least one embodiment, the first and second backing member segments extend substantially perpendicular to each other.

In at least one embodiment, the backing member is substantially L-shaped and the first and second backing member segments are integrally formed with each other.

In at least one embodiment, the backing member is securable to at least one of the wrapper material web and the article and detachable from the backing member positioner.

In at least one embodiment, the positioner actuator is configured for selectively moving the backing member between an idle position in which the backing member is located below the article and is substantially aligned with the desired location and an operative position in which the backing member is positioned against the article at the desired location.

In at least one embodiment, the fastening device comprises an adhesive applicator for applying an adhesive on the wrapping material web between the overlying and underlying material web portions to secure the overlying and underlying material web portions together.

In at least one embodiment, the adhesive applicator is configured to apply an adhesive portion on an outer surface of the second wrapping material web section, the adhesive portion comprising an adhesive strip having at least one segment extending substantially parallel to the first lateral edge of the first peripheral face and is aligned with the backing member in the wrapping configuration on the article.

In at least one embodiment, the apparatus further comprises a pressing assembly for pressing the overlying material web portion against the underlying web portion with the adhesive applied between the overlying and underlying web portions to promote adhesion between the overlying and underlying web portions.

According to another aspect, there is also provided a method for wrapping at least a portion of an article with a wrapper material web. The method comprises: superposing at least one backing member to a face of the article wherein the at least one backing member is covered at least partially by the wrapper material web using a backing member positioner holding the at least one backing member and including a positioner actuator; and then, securing at least one of: at least two superposed sections of the wrapper material web using the at least one backing member as support, and the wrapper material web to the at least one backing member.

According to a further aspect, there is also provided a method for wrapping at least a portion of an article with a wrapper material web. The method comprises: superposing at least one backing member to a peripheral face of the article at a desired location along the article, wherein the at least one backing member is covered at least partially by the wrapper material web; and then, securing at least one of: at least two superposed sections of the wrapper material web using the at least one backing member as support, and the wrapper material web to the at least one backing member.

In at least one embodiment, the method further comprises covering at least a portion of the face of the article having the at least one backing member superposed thereto with the wrapper material web.

In at least one embodiment, the method further comprises applying adhesive to the wrapper material web and wherein covering the at least a portion the face of the article having the at least one backing member superposed thereto with the wrapper material web comprises aligning at least partially the adhesive applied to the wrapper material web with the at least one backing member.

In at least one embodiment, the securing of the wrapper material web comprises applying pressure to a section of the wrapper material web including the adhesive and covering the at least one backing member.

In at least one embodiment, the superposing the at least one backing member to the peripheral face of the article comprises superposing simultaneously two backing members to two opposed one of the peripheral face, adjacent to and substantially along a respective one of lateral edges of the article and further comprising folding the wrapper material web about the lateral edges and against the two opposed peripheral faces.

In at least one embodiment, the superposing the at least one backing member to the peripheral face of the article comprises superposing simultaneously two backing members to a respective one of the peripheral face, adjacent to and substantially along a respective one of lateral edges of the article delimitating the respective one of the peripheral face and further comprising folding the wrapper material web about the lateral edges and against the respective peripheral face.

In at least one embodiment, the method further comprises folding at least a first wrapping material web section against at least a first one of the peripheral face before superposing the at least one backing member to at least a second one of the peripheral face, adjacent to the at least a first one of the peripheral face.

In at least one embodiment, the method further comprises folding at least a second wrapping material web section and a third wrapping material web section over the at least one backing member superposed to the article.

In at least one embodiment, the securing comprises securing the at least two superposed sections of the wrapper material web using the at least one backing member as support, and the method further comprises removing the at least one backing member following the securing of the at least two superposed sections of the wrapper material web.

DETAILED DESCRIPTION

Figure 1:
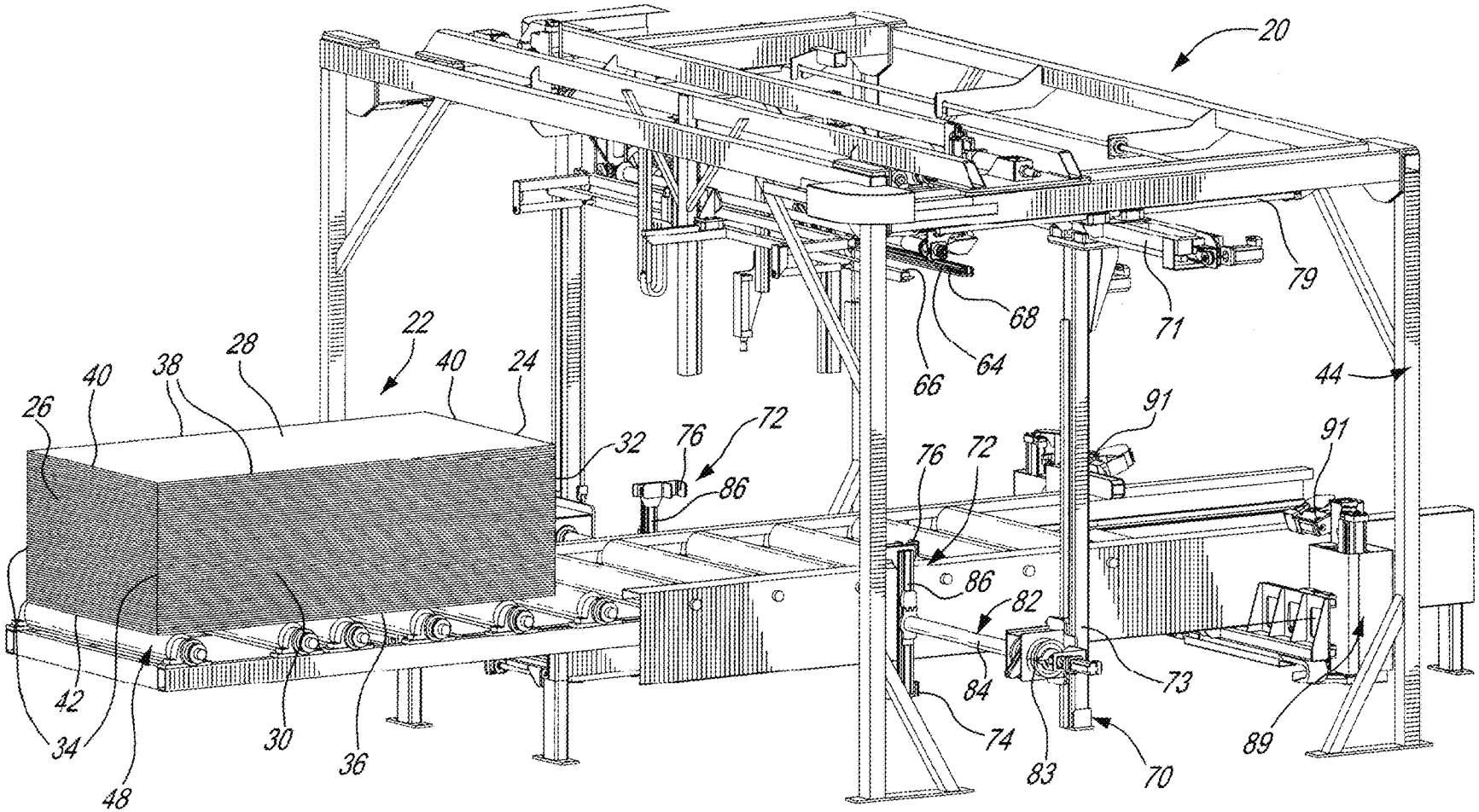
FIG. 1 is a perspective view of an apparatus for wrapping an article, in accordance with one embodiment.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Referring to FIG. 1, there is shown a wrapping apparatus 20, in accordance with one embodiment. The wrapping apparatus 20 is configured for wrapping an article, more particularly a substantially parallelepiped-shaped article 22 such as, without being limitative, a bundle of lumber, plywood or chipboard, I-joists, open-web joists, drywall panels or a pile of other articles, for instance, articles used in construction work, or a paper or pulp bale or any other article suitable to be wrapped.

The generally parallelepiped-shaped article 22 has an upper face 28 and an opposed lower face (now shown), which are interconnected by four (4) peripheral faces 24, 26, 30. The peripheral faces 24, 26, 30 include a front (first) end face 24, a rear (second) end face 26, opposed to the front end face 24, and two opposed lateral faces 30 extending between the front and the rear end faces 24, 26. The front end face 24 and the lateral faces 30 meet at front lateral edges 32. Similarly, the rear end face 26 and the lateral faces 30 meet at rear lateral edges 34. Each lateral face 30 extends between a lower longitudinal edge 36 and an upper longitudinal edge 38. Each of the front and the rear end faces 24, 26 meets with the upper face 28 at an upper transversal edge 40 and meets with the lower face at a lower transversal edge 42.

In one embodiment, the wrapping apparatus 20 may be substantially similar to the wrapping apparatus disclosed in U.S. Pat. No. 8,534,033, the specification of which is incorporated herein in its entirety. Specifically, the wrapping apparatus 20 includes a wrapping station frame 44 defining a longitudinal direction 46 (see FIG. 2) of the wrapping apparatus 20. Still in the illustrated embodiment, the wrapping apparatus 20 further includes a conveyor 48 extending along the longitudinal direction 46 below the wrapping station frame 44. Alternatively, the wrapping apparatus 20 may not include a conveyor 48 and the article 22 may instead be placed under the wrapping station frame 44 through any suitable article positioning means, and remains in a fixed location during the wrapping process. Still in another embodiment (not shown), the conveying means can vary from the conveyor 48 shown in the Figures.

Figure 2:
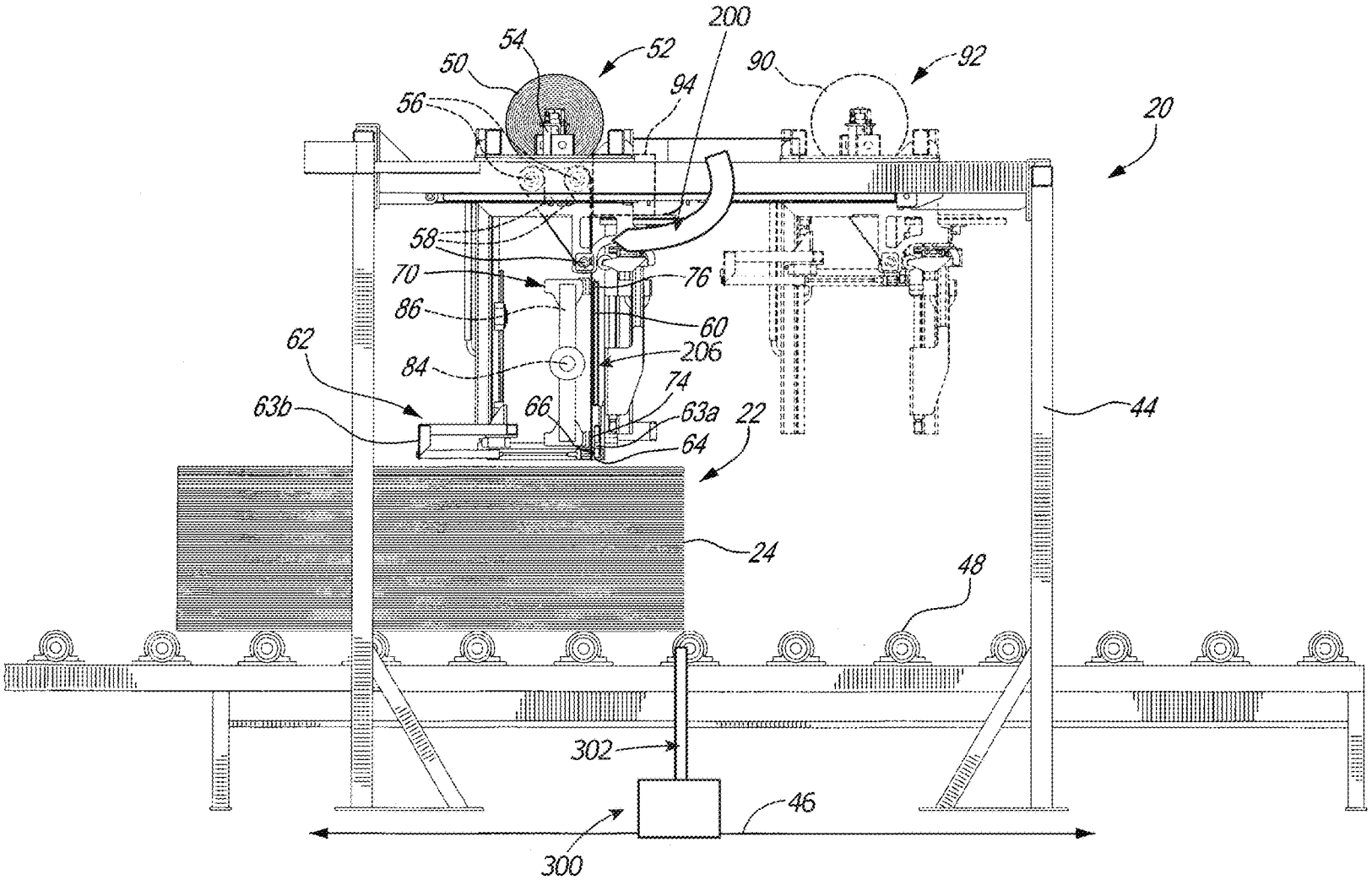
FIG. 2 is a side elevation view of the wrapping apparatus of FIG. 1, showing a wrapping step where an article to be wrapped is moved to a wrapping station.

Referring now to FIG. 2, the apparatus 20 includes a wrapper delivery unit 52 with a wrapper delivery unit frame 54 carrying a web material roll 50 of wrapper material 60 (or wrapper material web). In the illustrated embodiment, the wrapper delivery unit frame 54 includes two supporting rolls 56 on which the web material roll 50 is rotatably mounted. In some embodiments, the supporting rolls 56 can be motorized to facilitate delivery of the wrapper material from the web material roll 50. It is appreciated that, in alternative embodiments, the wrapper delivery unit can differ from the embodiment shown.

In the illustrated embodiment, the wrapper material 60 extends from the web material roll 50, around the supporting rolls 56 and around a plurality of guiding rolls 58, and to a wrapper dispenser 62. The wrapper dispenser 62 is movable in translation between a lower position (shown in FIGS. 2 to 5) and a higher position (shown in FIGS. 6 to 10). The wrapper dispenser 62 includes a dispenser frame having a fixed arm 63*a* and a moveable arm 63*b*, which in the embodiment shown is slidable, but can alternately be pivotable. The fixed arm 63*a* carries a wrapper guiding member 64 while the moveable arm 63*b* carries a wrapper dispensing stopper 66, opposed to the guiding member 64. The fixed arm 63*a* can include a wrapper cutter 68 to cut the wrapper material 60 at a predetermined length, which is adjusted in accordance with the article 22 being wrapped. In one embodiment, the wrapper cutter 68 includes a blade cutter. Alternatively, the wrapper cutter 68 could include any other suitable cutting mechanisms, such as for example a heated wire. It is appreciated that, in alternative embodiments, the wrapper dispenser can differ from the embodiment shown.

Thus, the wrapper dispenser 62 allows wrapper material dispensing when the wrapper dispenser 62 is in a dispensing configuration (for example in FIG. 3A) and prevents wrapper material dispensing when the wrapper dispenser 62 is a non-dispensing configuration (for example in FIG. 2). In the non-dispensing configuration, the wrapper dispensing stopper 66 abuts the guiding member 64, with the wrapper material 60 extending therebetween, and in the wrapper material dispensing configuration, the wrapper dispensing stopper 66 slides away from the guiding member 64 to be spaced apart therefrom.

The wrapper dispenser 62 could be operatively connected to a controller, not shown, which controls for example the wrapper material dispensing timing and/or the quantity of wrapper material dispensed. Both variables can be adjusted in accordance with the length of the article being wrapped.

Referring to FIG. 2, the wrapping apparatus 20 can also include one or several spare wrapper material rolls 90 (only one is shown in FIG. 2), which are mounted on spare wrapper delivery units 92.

In some embodiments, the wrapping apparatus 20 may further include a wrapper material identifying unit 94 such as a printer or a labeling apparatus for printing, on the wrapper material, information such as information regarding the article being wrapped or advertising information or any other desired information. The position of the wrapper material identifying unit can vary from the embodiment shown.

Referring back to FIG. 1, the wrapping apparatus 20 also includes a wrapper applicator 70 for positioning the wrapping material 60 in a wrapping configuration on the article 22. Specifically, in the illustrated embodiment, the wrapper applicator 70 is configured for applying the wrapping material 60 on the upper and peripheral faces 28, 24, 26, 30 of the article 22.

In the illustrated embodiment, the wrapper applicator 70 includes two wrapper gripping units 72. Each wrapper gripping unit 72 is mounted on a respective lateral side of the apparatus 20, i.e. on a respective lateral side of the conveyor 48. In the illustrated embodiment, both gripping units 72 are substantially similar, and therefore only one gripping unit 72 will be described below. Alternatively, each gripping unit 72 could have a configuration different from the other gripping unit 72.

Each wrapper gripping unit 72 includes spaced-apart first and second wrapper grippers 74, 76. Both wrapper grippers 74, 76 are designed to grab the wrapper material 60 proximal to a longitudinal edge thereof. In one embodiment, the distance between the wrapper grippers 74, 76 can be adjusted, either before the wrapping process or during the wrapping process as required, either manually or automatically.

It is appreciated that, in an alternative embodiment, the wrapper applicator 70 can vary from the embodiment shown. For instance and without being limitative, the wrapper applicator 70 can still include two wrapper gripping units, mounted on a respective lateral side of the apparatus 20. However, each one of the gripping units can include two spaced apart and independently movable wrapper grippers, such as two spaced-apart robots having an end effector (or a prehension end) for gripping and manipulating the wrapper material 60.

In the illustrated embodiment, the wrapper applicator 70 includes a horizontally extending transverse frame member 71 slidably mounted to top rail members 79 which extends from on a top portion of the wrapping station frame 44. As such, the transverse frame member 71 can be translated along the longitudinal direction 46 of the apparatus 20. The wrapper applicator 70 also includes a vertical frame member 73 on each side of the conveyor 48, each vertical frame member 73 having a top end slidably mounted to the transverse frame member 71 such that the vertical frame member 73 can be translated along a transverse direction, i.e. toward and away from the conveyor 48. Each gripping unit 72 has a base member 83 slidably mounted to a respective one of the vertical frame members 73, such that the base member 83 can be translated along an at least substantially vertical axis. As such each gripping unit 72 can be moved relative to the article to be wrapped along longitudinal, transverse and vertical directions.

Each gripping unit 72 includes a rotatable arm 82 which is substantially T-shaped with a first arm section 84 having one end rotationally mounted to the base member 83 and an opposed end attached to a second arm section 86. The second arm section 86 extends perpendicularly to the first arm section 84 and has two opposed ends carrying a respective one of the wrapper grippers 74, 76. As mentioned above, in one embodiment, the second arm section 86 and wrapper grippers 74, 76 are configured so that the distance between the wrapper grippers 74, 76 can be varied.

Thus, the wrapper grippers 74, 76 can be oriented relative to one another along a substantially vertical plane, along a substantially horizontal plane, or along any other plane extending therebetween to manipulate the wrapper material 60.

In one embodiment, the wrapper grippers 74, 76 include clamps designed to clamp the wrapper material 60, proximate to the longitudinal edge thereof.

The wrapper grippers 74, 76 can be controlled independently, i.e. the operation and/or the position of each gripper is controlled independently to the operation and/or the position of the other gripper, or simultaneously, i.e. the operation and/or position of each gripper is associated with a predetermined operation and/or position of the other gripper.

In other embodiments, instead of including the two wrapper grippers 74, 76, the gripping units 72 could include only one wrapper gripper or more than two wrapper gripper(s).

In one embodiment, the gripping unit 72 is displaced along the apparatus 20 for carrying the various wrapping steps. Alternatively, the article 22 could be displaced relatively to the gripping units 72. In yet another embodiment, the various steps can be carried out with a combination of griping unit displacement and article displacement.

As mentioned above, it is appreciated that, in alternative embodiment, each one of the wrapper grippers of one of the gripping units can be configured to move independently of the other wrapper gripper.

In an alternative embodiment (not shown), each one of the gripping units 72 can include two sets of gripping units 72, as described above. Thus, the wrapper applicator 70 can include two horizontally extending transverse frame members 71 slidably mounted on the top rail members 79 in a manner such that the transverse frame members 71 can be translated along the longitudinal direction 46 of the apparatus 20. For each transverse frame members 71 and on each side of the conveyor 48, the wrapper applicator 70 can also include a respective vertical frame member 73 having a top end slidably mounted to the respective transverse frame member 71 such that the vertical frame member 73 can be translated along a transverse direction, i.e. toward and away from the conveyor 48. One of the gripping units 72 can be slidably mounted to each one of the vertical frame members 73, as described above to be movable relative to the article to be wrapped along longitudinal, transverse and vertical directions. Each one of the gripping units 72 can include two wrapper grippers 74, 76, thereby providing four wrapper grippers 74, 76 on each side of the conveyor 48 and can be controlled independently.

The wrapping apparatus 20 further includes a fastening device 89 which is configured for maintaining the wrapping material 60 in its wrapping configuration on the article 22, i.e. in a configuration in which the wrapping material 60 covers the upper and peripheral faces 28, 24, 26, 30 of the article 22.

In the illustrated embodiment, the fastening device 89 includes a pair of movable stapling mechanisms 91, one mechanism 91 being provided on each side of the article 22 and mounted on a transverse member slidably retained on the wrapping station frame 44. In an alternative embodiment (not shown), the stapling mechanism 91 could instead be slidably retained on rails fixed to the floor. Each stapling mechanism 91 includes a stapling head which is movable along the height or the article as well as towards and away from the article, in order to be able to staple the wrapper material 60 to the article 22 in any desired location. The fastening device 89 can be operatively connected to a controller for controlling the timing for the insertion and the position of the fasteners. In an alternative embodiment, the fastening device 89 could be integrated with the wrapper grippers 74, 76, for example by including an integrated stapling head with at least one of the wrapper grippers 74, 76. The fastening device 89 could also alternately be manually operated.

Figure 3A:
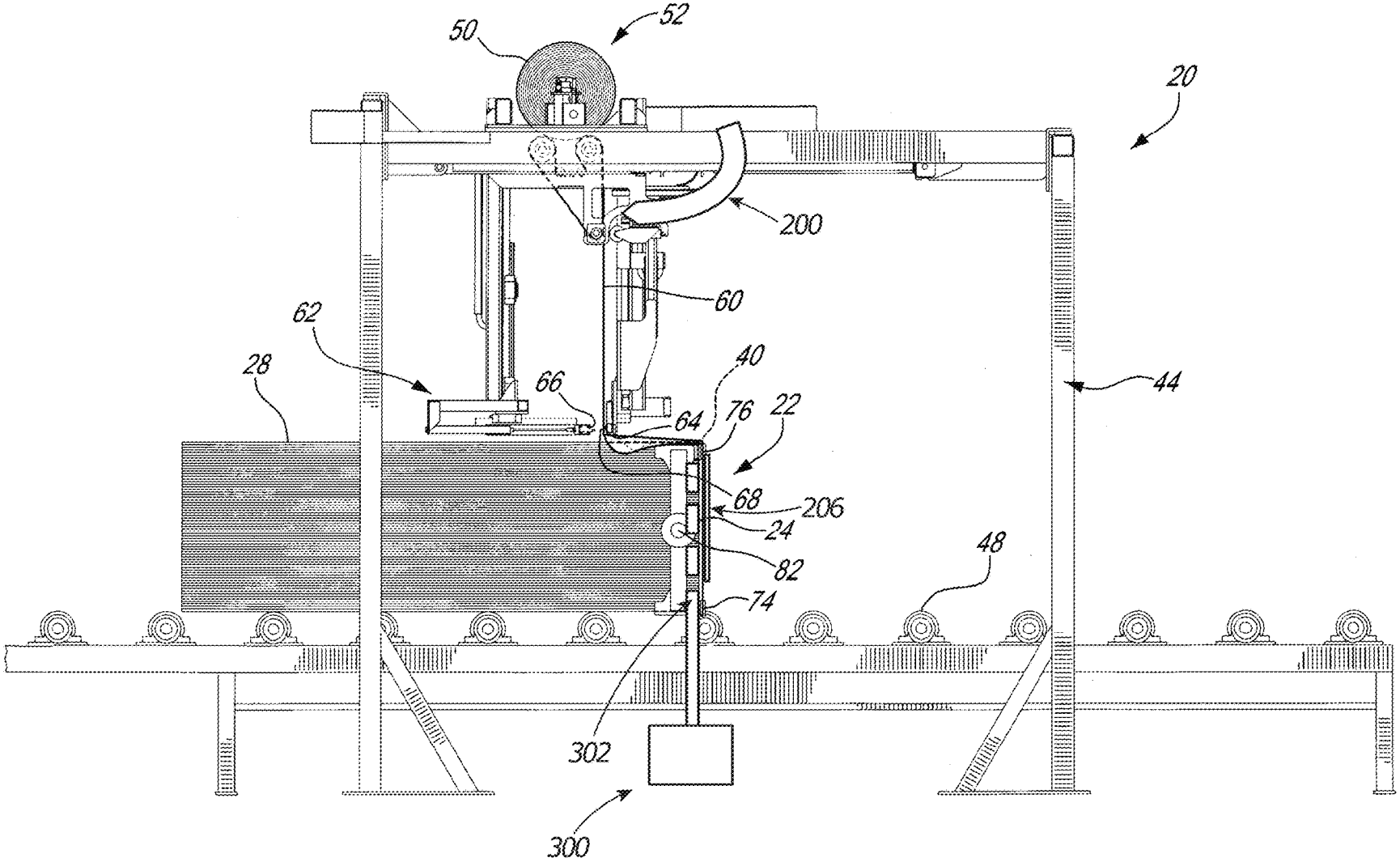
FIG. 3A is a side elevation view of the wrapping apparatus shown in FIG. 1 showing a wrapping step where a section of the wrapper material is applied to a front end face of the article.

In the illustrated embodiment, as shown in FIGS. 2 and 3A, the fastening device 89 also includes an adhesive applicator 200 for applying an adhesive on the wrapping material 60. The adhesive applicator 200 can include one or more adhesive application head(s). In an embodiment, the adhesive applicator 200 includes two adhesive application heads or dispensers, such as and without being limitative glue guns, each one being mounted on a respective lateral side of the apparatus 20, i.e. on a respective lateral side of the conveyor 48. In one embodiment, the adhesive may include hot-melt adhesive, wet adhesive, and/or pressure-sensitive adhesive. Alternatively, various other suitable types of adhesive and of adhesive applicator could be used instead.

In an alternative embodiment, the adhesive applicator 200 and/or the stapling mechanisms 91 includes two sets of adhesive application heads or dispensers and/or the stapling mechanisms 91, one set on each lateral side of the apparatus 20. Each set can include one or more adhesive application heads or dispensers. For instance, front ones can be located adjacent to the front face 24 of the article 22 being wrapped in the wrapping station (one on each lateral side of the apparatus 20) and second ones can be located adjacent to the rear face 26 of the article 22 (one on each lateral side of the apparatus 20).

In the illustrated embodiment, the adhesive applicator 200 may include two glue applicator rollers, positioned spaced-apart from one another and adjacent the wrapper delivery unit 52. The glue applicator rollers are substantially static along a vertical axis but their spacing can be adjusted in accordance with the width of the article being wrapped and/or to apply adhesive transversally on the wrapping material 60. When the wrapper material 60 is moved from the wrapper delivery unit 52 towards the guiding member 64, the adhesive applicator 200 may be activated and apply adhesive on the wrapper material 60, such that movement of the wrapper material 60 forms adhesive strips 206. Alternatively, the adhesive applicator 200 could be movable along the wrapper material 60 to form the adhesive strips 206.

It is appreciated that, in an alternative embodiment, the fastening device 89 can include only one of the stapling mechanism 91 and the adhesive applicator 200.

In the illustrated embodiment, which is non-limitative, the apparatus 20 further includes a backing member positioner 300 for positioning a backing member 302 between the wrapper material 60 and the article 22. In the illustrated embodiment, the backing member positioner 300 includes two sets, each one being mounted on a respective lateral side of the apparatus 20, i.e. on a respective lateral side of the conveyor 48. In a non-limitative embodiment, the backing member 302 is elongated and flat, and is positionable so as to extend against one of the faces of the article to provide a physical support when folding and/or securing the wrapper material 60 to the article or to itself.

The backing members 302 can be made of a rigid material such as wood, rigid polymer, steel or any other suitable material.

In the embodiment shown in the figures, the backing members 302 are represented as an elongated material strip. However, it is appreciated that their shape can vary from the embodiment shown. For instance and without being limitative, the backing members 302 could be L-shaped to provide support in two orthogonal directions.

It is appreciated that, in other embodiments, the wrapping apparatus 20 can be exempt of backing member positioner 300 and the article 22 can be wrapped without using backing member(s) 302.

In an embodiment, the backing member positioner 300 can include a prehension unit to hold and maintain the backing member and a positioner actuator operatively connected to the prehension unit to displace same with respect to the article 22 being wrapped and position the backing member, hold by the prehension unit at a desired location with respect to the article 22. Therefore, the backing member positioner 300 can insert, support, and, optionally withdraw backing members 302 at different positions and in different configuration with respect to the article 22 being wrapped. In an embodiment, the prehension unit can seize, hold and release the backing member. In an embodiment, the positioner actuator can displace at least a portion of the backing member positioner 300 including atheprehension unit for the backing member in three axes, i.e. along a transversal axis (towards and away from the article 22), along the longitudinal axis 46, and along a vertical axis. In an alternative embodiment, the article 22 can be displaced during the wrapping process with respect to the backing member positioner 300 to modify the position wherein the backing members 302 are positioned on the article 22. In such alternative embodiment, displacement of the prehension unit of the backing member positioner 300 in the longitudinal direction is not compulsory. It is appreciated that the backing member positioner 300 can include more than one positioner actuator to allow displacement along the different axes and/or more than one prehension unit to seize and hold more than one backing member.

It is appreciated that the wrapping apparatus 20 can include more than one backing member positioner 300 on each lateral side of the article 22 being wrapped, such as on each side of the conveyor 48. For instance and without being limitative, the wrapping apparatus 20 can include sets of backing member positioners 300 on each lateral side of the article 22 being wrapped. For instance, front ones can be located adjacent to the front face 24 of the article 22 being wrapped in the wrapping station (one on each side of the conveyor 48) and second ones can be located adjacent to the rear face 26 of the article 22 (one on each side of the conveyor 48).

Figure 5:
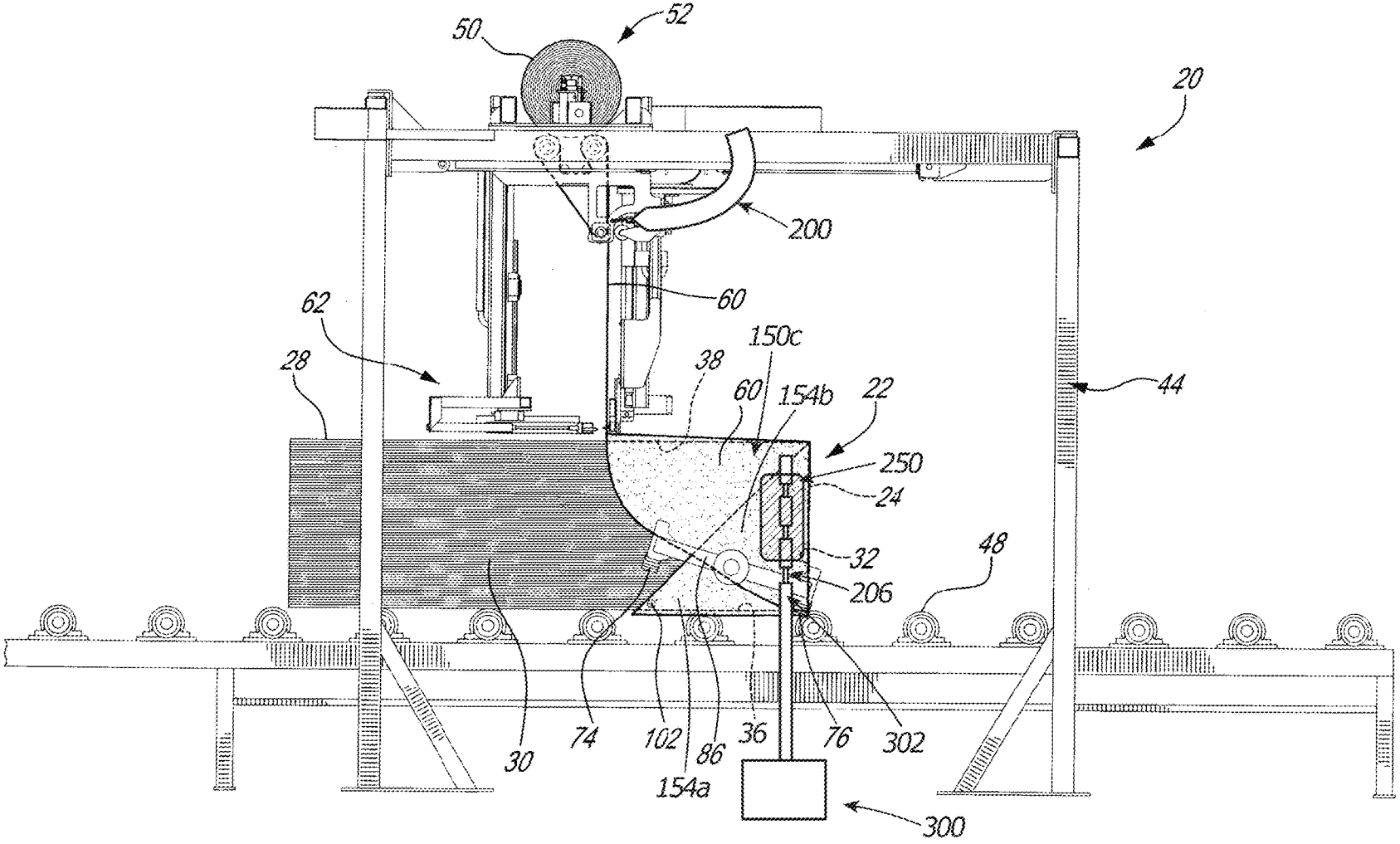
FIG. 5 is a side elevation view of the wrapping apparatus shown in FIG. 1, showing a wrapping step where sections of the wrapper material are folded around upper edges of the article and over the lateral faces.

In the illustrated embodiment, the wrapping apparatus 20 further includes a pressing assembly 250, as shown in FIG. 5, for pressing against an overlying portion 154*b* of the wrapping material 60, as will be described in more details below. The pressing assembly 250 may include a pressing member and an actuator, such as an electric, hydraulic or pneumatic actuator, which could move the pressing member towards the wrapping material 60 and the article 22 applied thereon and, more particularly, in a direction substantially normal to one of the faces of the article 22, such as one of the lateral faces 30 of the article 22. It can include one or more rollers at an end thereof to contact the wrapping material 60 covering the article 22. The rollers can be oriented in different directions, one or more having a rotation axis extending substantially vertically and one or more having a rotation axis extending substantially horizontally. The rollers can be located forwardly of one or more pressing members, which apply pressure on the rollers to contact the wrapped article 22.

As for the adhesive applicator 200 and the backing member positioner 300, the pressing assembly 250 of the wrapping apparatus 20 can include a set of pressing units on each lateral side of the apparatus 20, such as on each side of the conveyor 48 or one each lateral side of the article 22 being wrapped. Furthermore, each set of pressing unit can include more than one unit on each lateral side. For instance and without being limitative, each set can include two units of the pressing assembly 250 on each side of the article 22 being wrapped, one can be located adjacent to the front face 24 of the article 22 being wrapped in the wrapping station and another one can be located adjacent to the rear face 26 of the article.

When the article 22 is wrapped, the article 22 is moved towards the wrapping material 60, with the front end face 24 located towards the wrapping material 60, as shown in FIGS. 2 and 3. For wrapping the article, a relative movement is provided between the wrapper material 60 and the article 22 to be wrapped wherein either the article 22 is conveyed along the conveyor 48 to the wrapping station or the wrapper material 60 is moved towards the front end face 24 of the article 22. In the embodiment described hereinbelow, the article 22 is conveyed along the conveyor 48.

The wrapper material 60 is seized by the gripping units 72 and gradually unrolled from the web material roll 50.

Figure 3B:
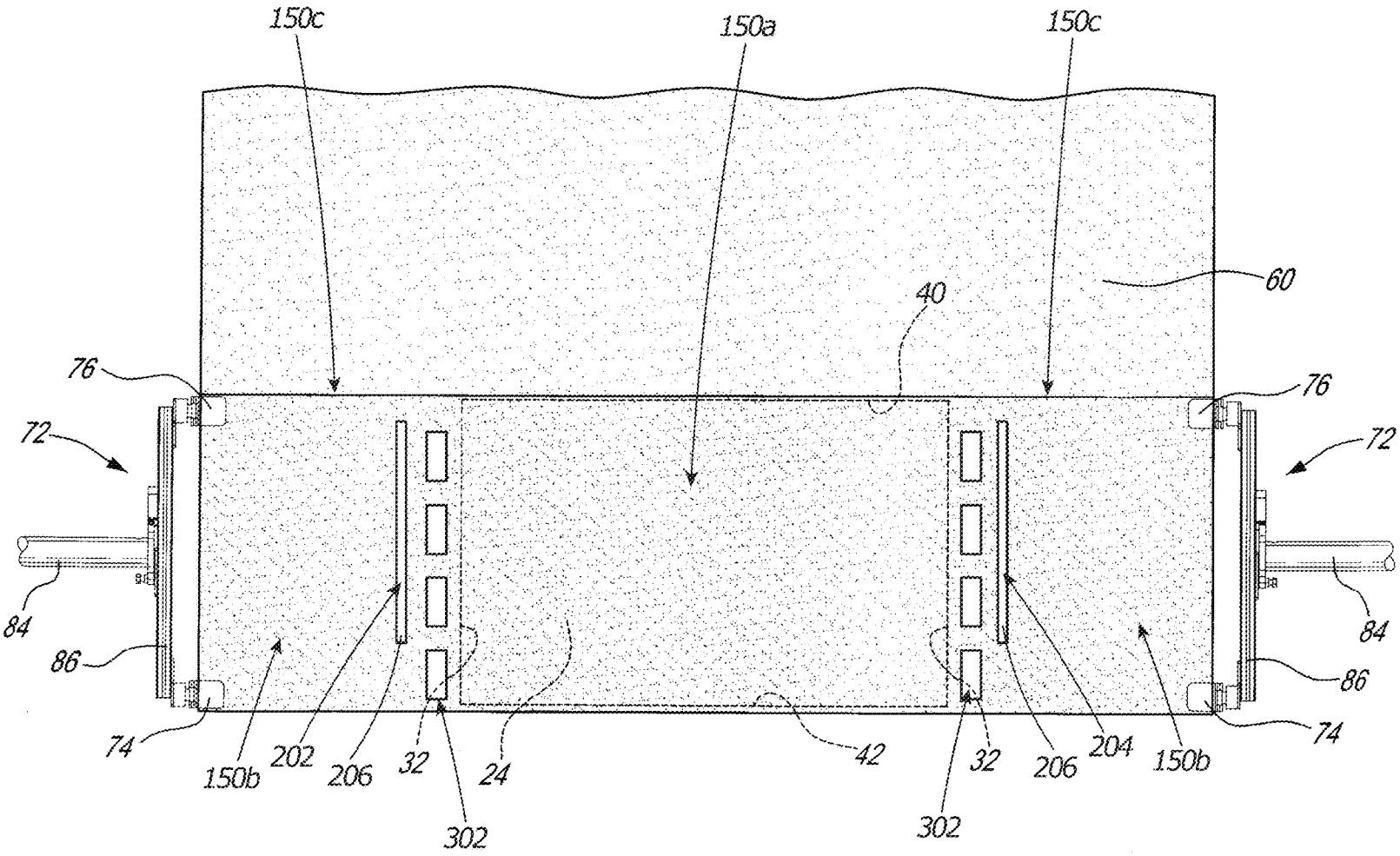
FIG. 3B is a schematic front elevation view of the article during the step illustrated in FIG. 3A.

Referring to FIG. 2, as the wrapper material 60 is unrolled and before contacting the article, strips of adhesive 206 are applied to an outer face of the wrapping material 60, i.e. the face that is exposed outwardly when the article 22 is wrapped with the wrapping material 60. In the embodiment shown, the adhesive applicator 200 is positioned so as to form a first adhesive portion 202 and a second adhesive portion 204 on the wrapping material 60 while it is unrolled from the web material roll 50. The first and second adhesive portions 202 are positioned on sections of the wrapper that will cover the lateral faces 30 of the article, adjacent to the first end face 24 (or front face). As shown in FIG. 3B, the adhesive strip extends from adjacent to a free end of the wrapping material and along a length thereof, i.e. parallel to the unrolling direction.

In an alternative embodiment (not shown), adhesive strips can also extend normal to the adhesive strips shown in FIG. 3B, from an inside end of the adhesive strips shown in FIG. 3B and towards a respective longitudinal edge of the wrapping material 60.

Then, the wrapper material 60 is further unrolled from the web material roll 50 by displacing the wrapper gripping units 72 forwardly, in front of the front end face 24, while the article 22 remains at the same position, as shown in FIG. 3A. It is appreciated that, in alternate embodiments, the relative movement can be provided from the article or from a combination of the wrapper material and the article.

The wrapper material 60 is positioned to cover the front end face 24 of the article with sections thereof extending past each lateral faces 30. The front end face 24 of the article 22 can be referred to as a first peripheral face being covered with the wrapper material 60.

Simultaneously and still referring to FIG. 3A, in some non-limitative embodiment, the backing member positioner 300 can position backing members 302 against the lateral faces 30 of the article 22 and, more particularly, substantially along the respective lateral edge 32 at a junction of the front end face 24 with the lateral faces 30. Specifically, the backing member 302 is shaped and positioned so as to extend substantially underneath the corresponding front adhesive strip 206 when the wrapping material 60 is folded against the lateral faces 30 of the article 22. The backing member positioner 300 can maintain the backing members 302 in the suitable positioned until they can be further withdrawn during the wrapping process, as will be described in more details below.

The backing members 302 can be used during the wrapping process in some situations wherein a portion of the article 22 beneath the wrapper material 60 is continuous or includes a gap or recess, such as the recess between upper and lower flanges of an I-joist or open-web joist.

Referring specifically to FIG. 3B, the wrapper material 60 is then first folded around the upper transversal edge 40 and superposed to the first end face 24 of the article 22 (i.e. the first peripheral face), and a lower edge of the wrapper material 60 is substantially aligned with the lower transversal edge 42 of the article 22. The wrapper material 60 is substantially aligned transversally with the article 22 such that it extends substantially equally beyond both front lateral edges 32 of the article 22.

As further shown in FIG. 3B, in this configuration, the wrapper material 60 has a first wrapping material section 150*a* extending over and covering the first end face 24, and second wrapping material sections 150*b* extending beyond the lateral edges 32 of the first end face 24, away from the first wrapping material section 150*a*. The wrapper material 60 further has third wrapping material sections 150*c* which extends beyond the upper longitudinal edge 38 of the respective lateral face 30, on either side of the article 22. Specifically, in the illustrated embodiment, the third wrapping material sections 150*c* are substantially perpendicular to the first and second wrapping material sections 150*a*, 150*b* and is substantially parallel to the upper face 28 of the article 22.

Each one of the second wrapping material sections 150*b* includes a respective one of the front adhesive strips 206 and are positioned to be aligned with a respective one of the backing member 302 in a folded configuration. In some implementations, the backing members 302 are shaped and positioned so as to extend substantially underneath the corresponding front adhesive strips 206 when the second wrapping material sections 150*b* are folded against their respective lateral face 30. The lateral faces 30 of the article 22 can be referred to as the second peripheral faces of the article 22 being covered with the wrapper material 60, adjacent to the first peripheral face, i.e. the front face 24 in this embodiment.

Figure 4:
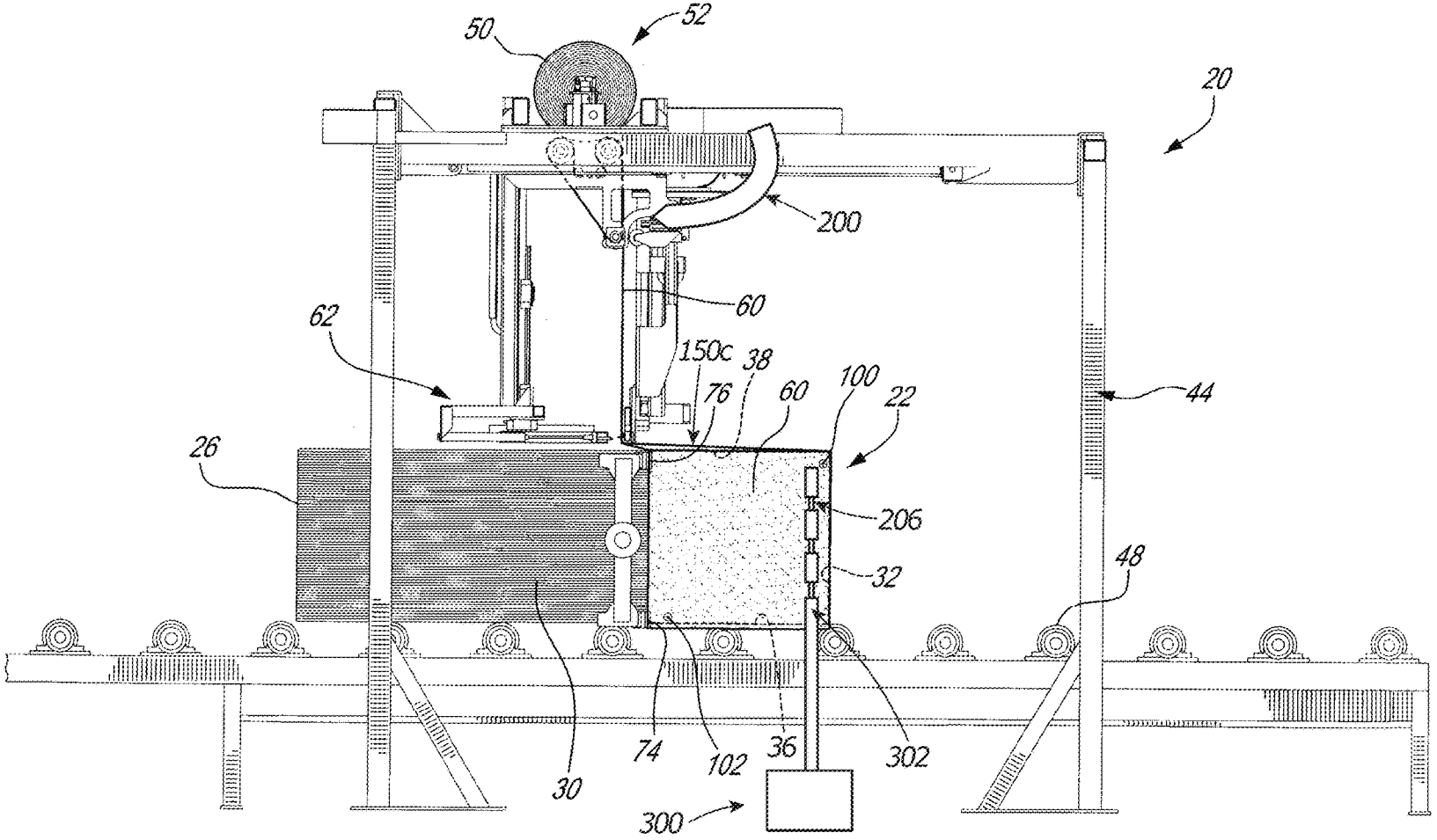
FIG. 4 is a side elevation view of the wrapping apparatus shown in FIG. 1, showing a wrapping step where sections of the wrapper material are folded around front lateral edges of the article and over lateral faces thereof.

Referring now to FIG. 4, to wrap a front portion of the article 22, each second wrapping material section 150*b* is folded about the respective lateral edge 32 of the front end face 24 and against the respective lateral face 30 using the wrapper gripping units 72. When the wrapper material 60 is folded about the respective lateral edge 32, the front adhesive strips 206 extend parallel and adjacent to a respective one of the front lateral edges 32, on a respective one of the lateral faces 30. They are aligned with a respective one of the backing member 302, with a respective one of second wrapping material sections 150*b* extending thereinbetween.

A corner of the wrapping material section 150*b* may be secured, with a first fastener 102, to the respective lateral face 30 of the article 22, proximate to the lower longitudinal edge 36 and spaced apart from the respective front lateral edge 32.

In an embodiment, the second wrapping material section 150*b* can also be secured to each lateral face 30 of the article 22 with a second fastener 100, adjacent to upper corners thereof, and more particularly, adjacent to the intersection with the respective front lateral edge 32 and the respective upper longitudinal edge 38, and with another second fastener 102 proximate to the lower longitudinal edge 36. In this embodiment, the first and second fasteners 100, 102, if any, extend through the wrapping material 60 and engage, i.e. penetrate, the article 22 beneath the wrapping material 60.

If backing members 302 are superposed to the article 22 before folding the second wrapping material section 150*b* against the lateral faces 30 of the article 22, the second fasteners 100 can be secured above the backing members 302, if the latter are withdrawn along the wrapping process, as described below. Otherwise, i.e. if the backing members 302 remain with the wrapped article, the second fasteners 100 can be inserted therein to secure the article 22, the wrapper material 60, and the backing members 302 together as an assembly.

Figure 6:
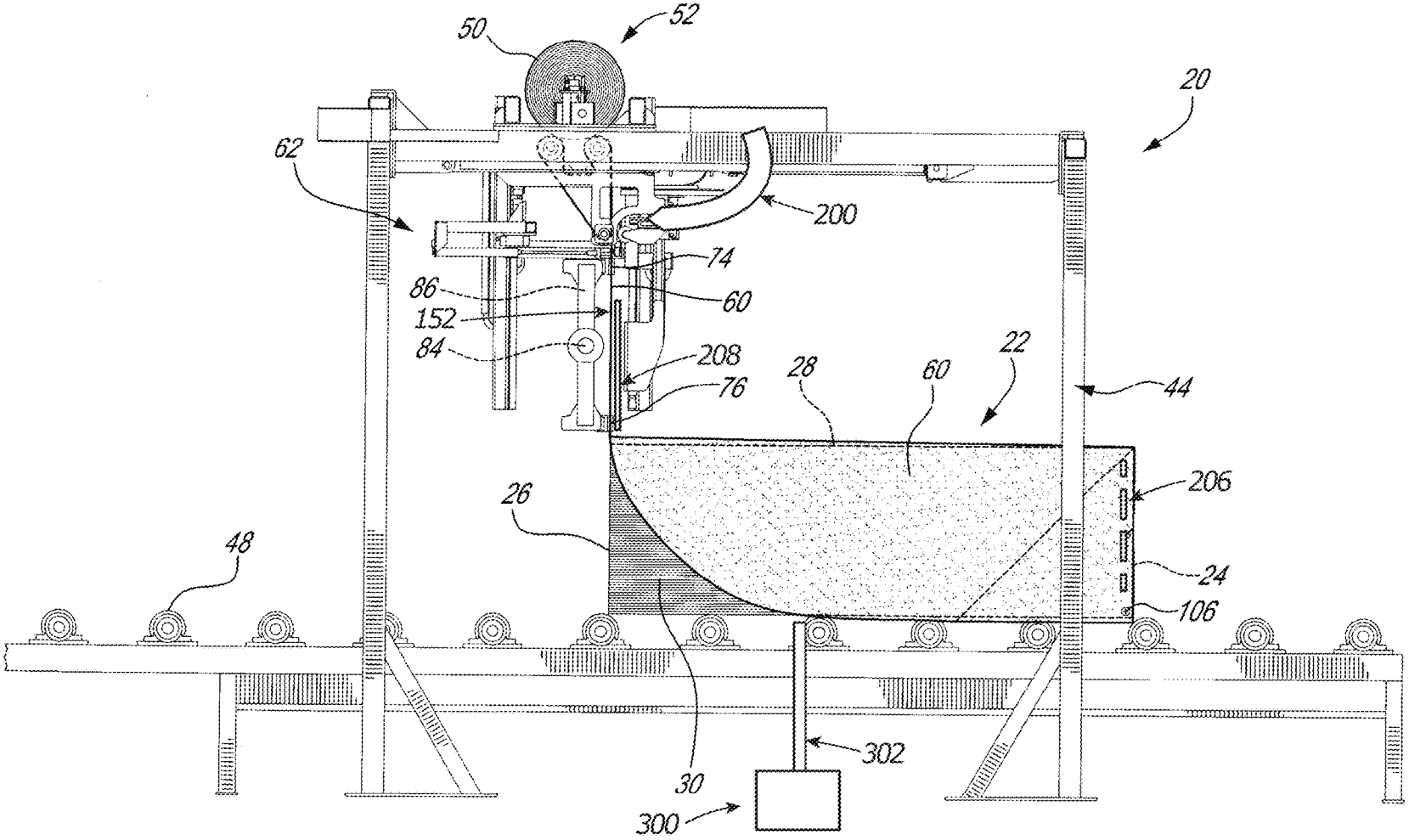
FIG. 6 is a side elevation view of the wrapping apparatus shown in FIG. 1, showing a wrapping step where the wrapper material is extended towards a rear end face of the article to cover an upper face thereof.

Referring now to FIG. 5, each third wrapping material section 150*c* is then folded about the respective upper longitudinal edge 38 and towards the lateral face 30 using the wrapper gripping units 72. As shown in FIGS. 5 and 6, the folding of the third wrapping material section 150*c* forms a multi-layered arrangement in the wrapping material 60 towards the lateral edge 32. This multi-layered arrangement includes a triangular portion of the second wrapping material section 150*b* which forms an underlying portion 154*a* of the multi-layered arrangement (which includes the front adhesive strips 206) and a triangular portion of the third wrapping material section 150*c* which forms an overlying portion 154*b* superposed over the underlying portion 154*a*.

When the third wrapping material sections 150*c* are folded about the respective upper longitudinal edge 38, the third wrapping material sections 150*c* cover the front adhesive strips 206.

To further wrap the front portion of the article 22, the underlying and overlying portions 154*a*, 154*b* of the wrapper material 60 are secured together via the front adhesive strips 206 which are sandwiched thereinbetween.

In the alternative embodiment wherein adhesive strips extend normal to the adhesive strips shown in FIG. 3B, from an inside end thereof and towards a respective longitudinal edge of the wrapping material 60, these second adhesive strips would be superposed to the front adhesive strips 206 in the wrapped configuration.

It may further be desirable to apply pressure on the overlying portions 154*b*, over the location of the front adhesive strips 206, to promote adhesion between the underlying and overlying portions 154*a*, 154*b*, as shown in FIG. 5. Pressure can be applied via the pressing assembly 250, which are displaced towards the third wrapping material section 150*c*, which is superposed above the underlying and overlying portions 154*a*, 154*b* and, more particularly, in the embodiment shown, superposed to the backing members 302.

Thus, the backing members 302 provide support or backing to the underlying portion 154*a* for the pressing assembly 250 to apply pressure on the overlying portion 154*b* over the front adhesive strip 206 to promote adhesion. In this configuration, the underlying portion 154*a*, the front adhesive strip 206, the overlying portion 154*b*, and third wrapping material section 150*c* are therefore sandwiched between the pressing member and the backing member 302.

Once pressure had been applied using the pressing assembly 250, the backing member 302 can be removed from the wrapping material 60, as shown in FIG. 6, via the backing member positioner 300.

In the embodiment shown and described above, the backing member 302 is positioned against the lateral face 30 before the second wrapping material sections 150*b* are folded against the lateral faces 30. Alternatively, the backing member 302 can be positioned after the second wrapping material sections 150*b* are folded against the lateral faces 30 by inserting the backing member 302 between the second wrapping material sections 150*b* and the article 22 from below.

Optionally, as shown in FIG. 6, third fasteners 106 can be inserted in the folded wrapper material 60 and the article 22, adjacent to lower corners thereof, and more particularly, adjacent to the intersection with the respective front lateral edge 32 and the respective lower longitudinal edge 36. In this embodiment, the third fasteners 106, if any, extend through the wrapping material 60 and engage, i.e. penetrate, the article 22 beneath the wrapping material 60. Optionally, the third fasteners 106 can extend through the backing members 302 if they are not withdrawn during the wrapping process.

In the illustrated embodiment, the article 22 can then be moved along the conveyor 48 until the rear end face 26 is substantially positioned to allow the rear portion of the article 22 to be wrapped, as shown in FIG. 6. The rear portion of the article 22 is wrapped substantially similarly to the front portion, as described above. Specifically, as the article 22 moves forward, the wrapping material 60 covers the upper face 28 and the lateral faces 30.

In an alternative embodiment, various components of the wrapping apparatus 20 can be displaced longitudinally with respect to the article being wrapped, instead of displacing the article 22 longitudinally.

The adhesive applicator 200 is configured to further apply rear adhesive strips 208, similar to the front adhesive strips 206, on the outer face of the wrapping material 60. More specifically, the adhesive applicator 200 is configured to apply the rear adhesive strips 208 such that they extend on a rearward section 152 of the wrapping material 60 which extends rearwardly and upwardly from the upper transversal edge 40 during the wrapping process. In an embodiment, the rear adhesive strips 208 are applied to the outer face of the wrapper material 60 as it is unrolled from the web material roll 50 and before it is separated from the web material roll 50 by the wrapper cutter 68 once the predetermined length of wrapper material 60 has been reached. In an alternative embodiment, the rear adhesive strips 208 can be applied to the outer face of the wrapper material 60 after it has been cut. Similarly to the front adhesive strips 206, the rear adhesive strips 208 are located on sections of the wrapping material 60 that extend laterally beyond the rear lateral edges 34 of the article 22. More particularly, the rear adhesive strips 208 are positioned on sections of the wrapper that will cover the lateral faces 30 of the article 22, adjacent to the rear face 26. The rear adhesive strips 208 extend from adjacent to a free end of the wrapping material 60 and along a length thereof, i.e. parallel to the unrolling/longitudinal direction.

As for the front adhesive strips 206, in an alternative embodiment (not shown), adhesive strips can also extend normal to the adhesive strips shown in FIG. 6, from an inside end of the adhesive strips shown in FIG. 6 and towards a respective longitudinal edge of the wrapping material 60.

Figure 7:
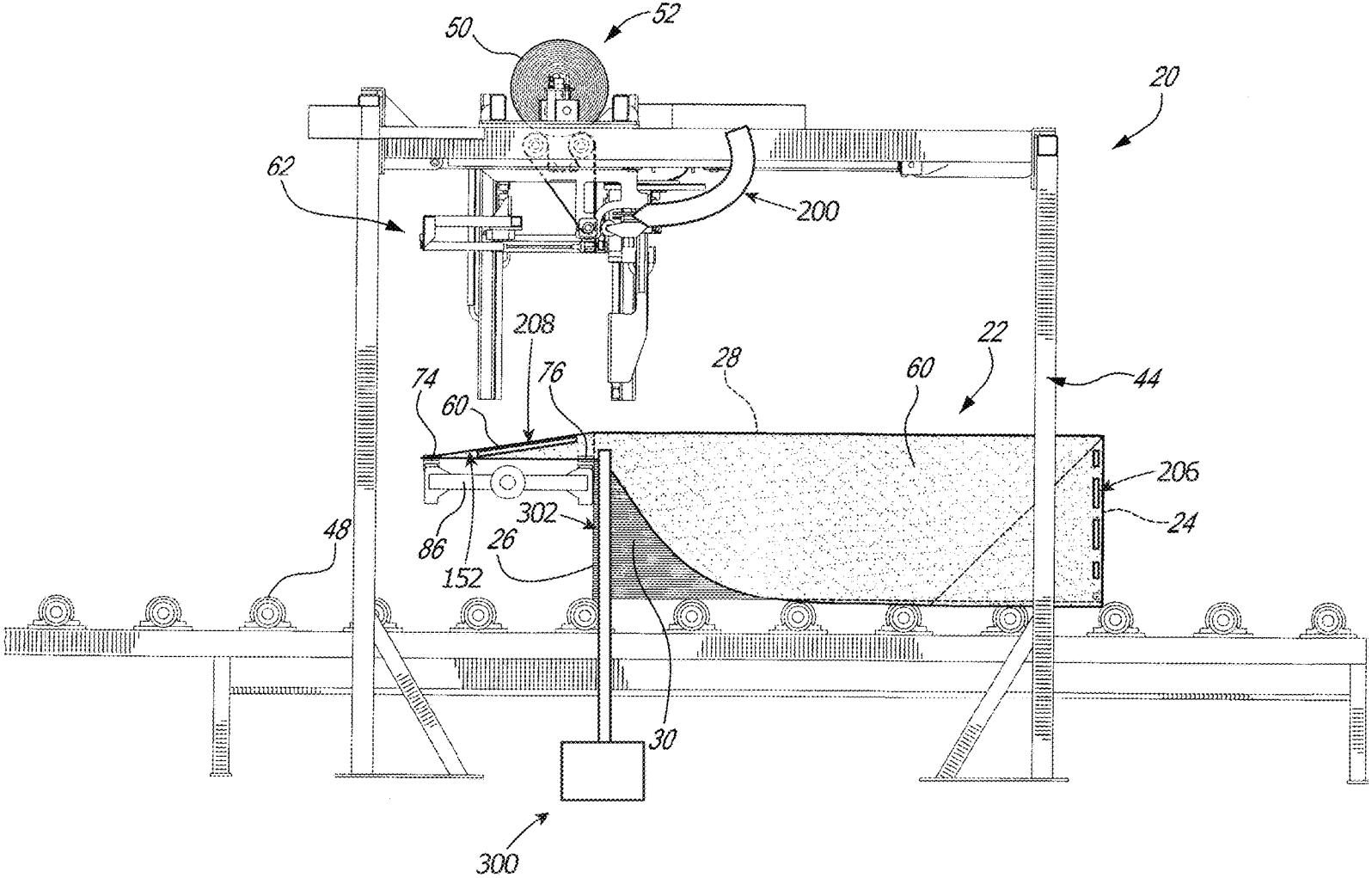
FIG. 7 is a side elevation view of the wrapping apparatus shown in FIG. 1, showing a wrapping step where the wrapper material is cut and extended beyond the rear end face.
Figure 8:
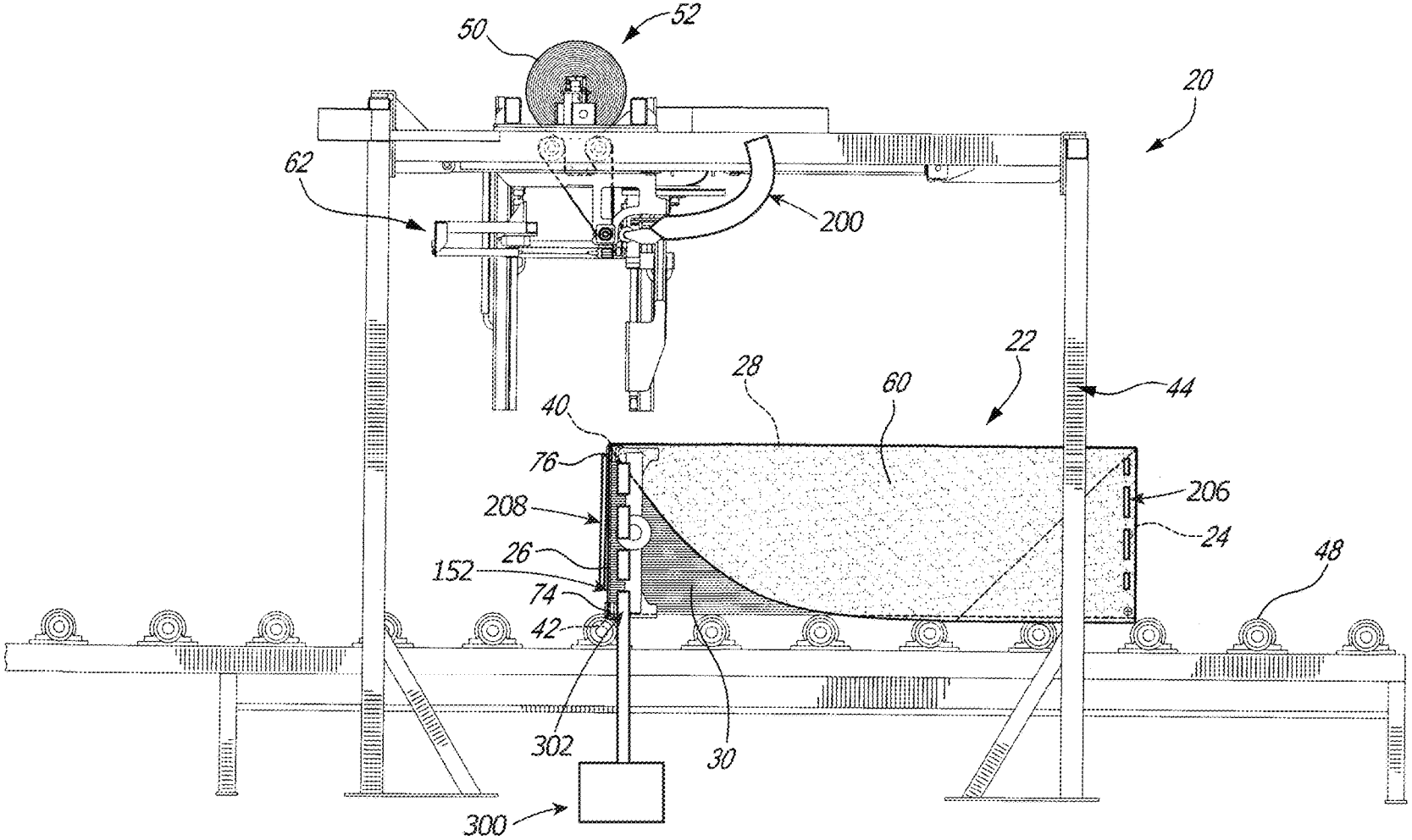
FIG. 8 is a side elevation view of the wrapping apparatus shown in FIG. 1, showing a wrapping step where the wrapper material is folded around an upper edge of the article and over the rear end face.

As shown in FIGS. 7 and 8, once the wrapping material 60 is cut, the rearward section 152 is lowered using the wrapper gripping units 72 to cover the rear face 26 of the article 22. More particularly, the rearward section 152 is folded against the upper transversal edge 40. In the illustrated embodiment, the backing member positioner 300 displaces the backing members 302 rearwardly to be substantially in alignment with a corresponding rear lateral edge 34 of the article 22, and upwardly to extend against the lateral faces 30 and along the respective one of the rear lateral edges 34 (best shown in FIG. 9).

Figure 9:
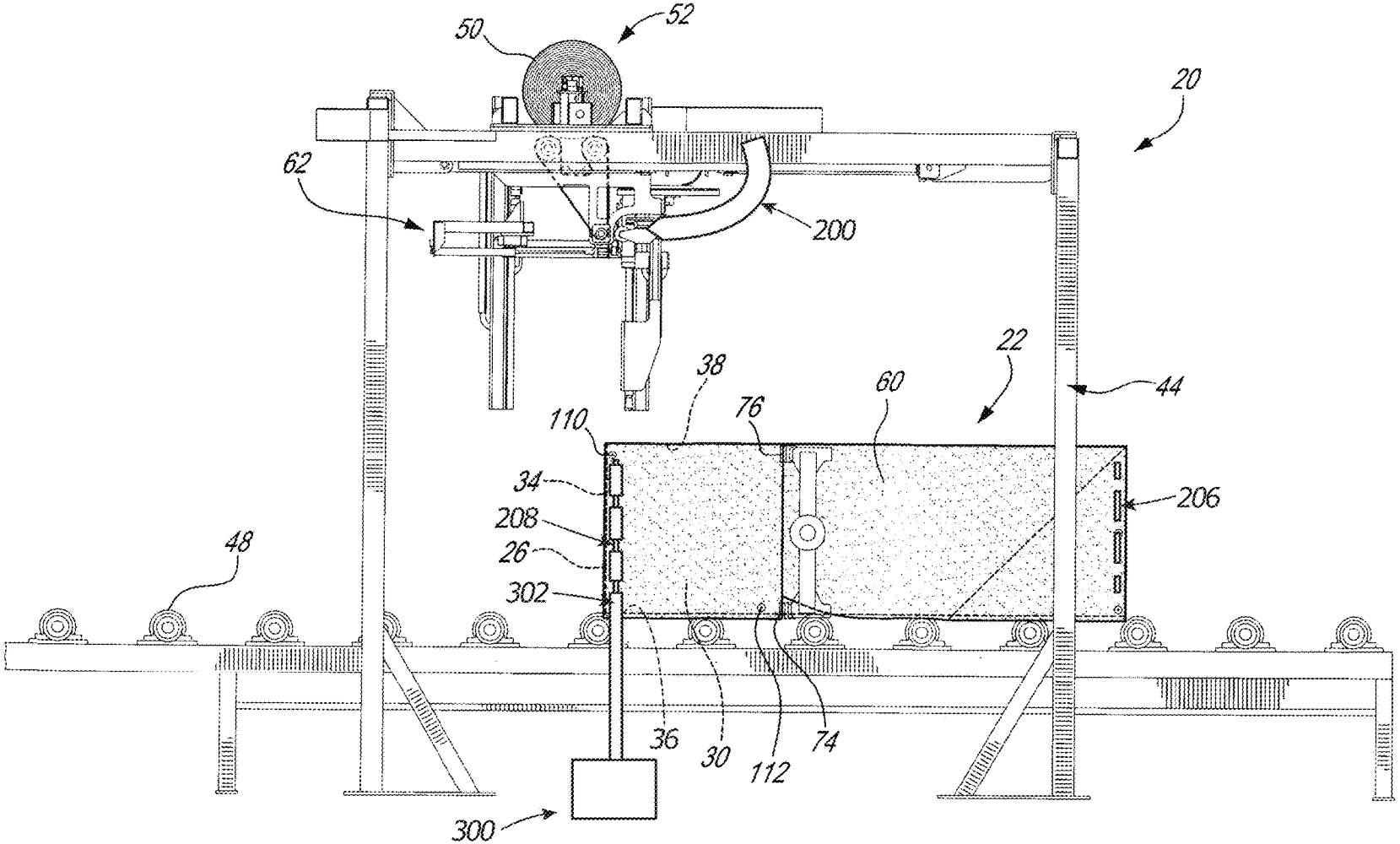
FIG. 9 is a side elevation view of the wrapping apparatus shown in FIG. 1, showing a wrapping step where sections of the wrapper material are folded around rear lateral edges of the article and over the lateral faces.

Still using the wrapper gripping units 72, the wrapping material 60 is then folded, first about the rear lateral edge 34 and against the lateral face 30, as shown in FIG. 9, and then about the upper longitudinal edge 38 and against the lateral face 30. Fasteners 110, 112, similar to the first and second fasteners 102, 100, may further be used to fasten the wrapping material 60 to the article 22.

Figure 10:
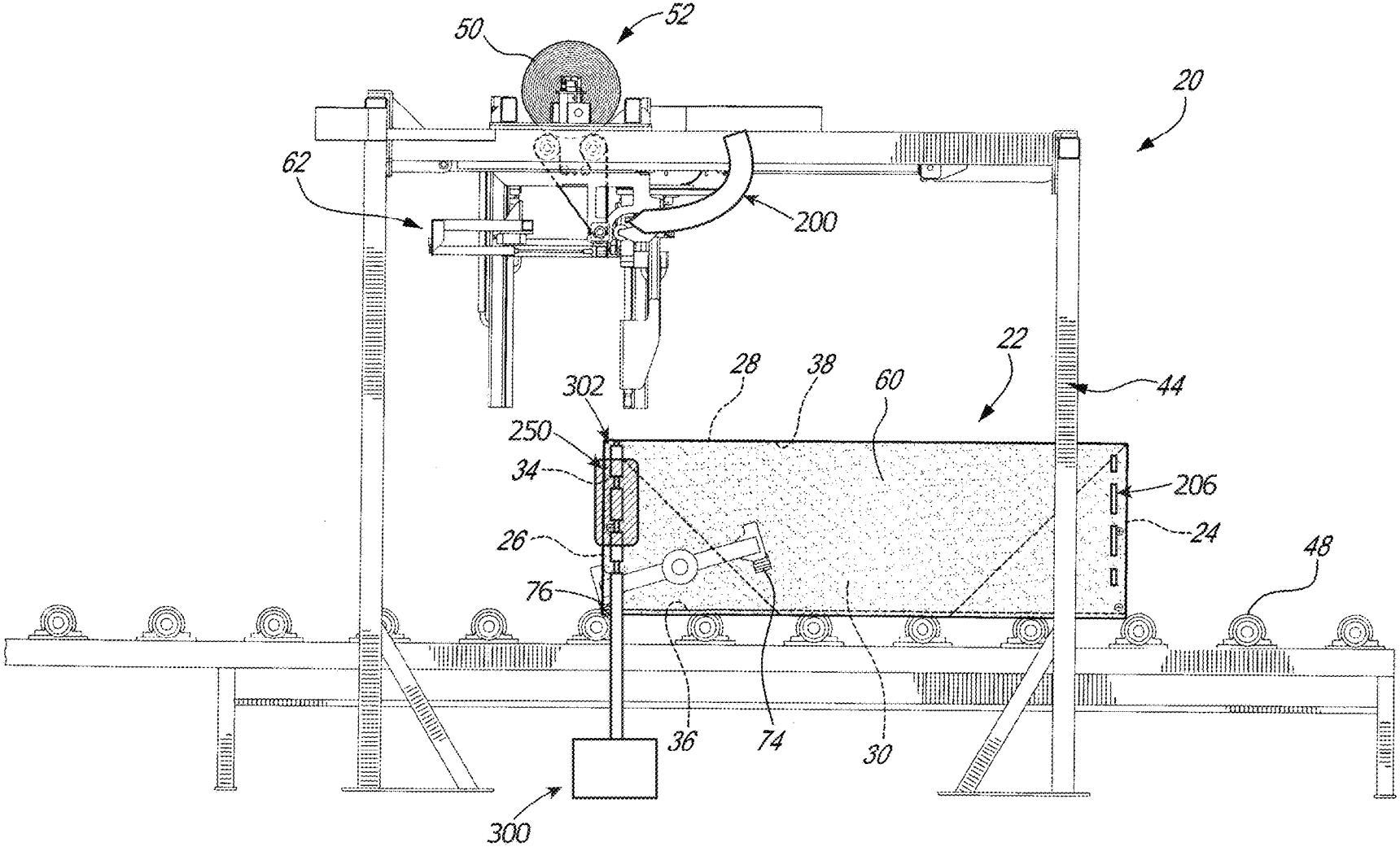
FIG. 10 is a side elevation view of the wrapping apparatus shown in FIG. 1, showing a wrapping step where sections of the wrapper material are folded around upper edges of the article and over the lateral faces.

This folding causes the backing members 302 to be aligned with the corresponding rear adhesive strip 208. As shown in FIG. 10, pressure may then be applied over the location of the rear adhesive strips 208. In the illustrated embodiment, pressure is applied using the pressing assembly 250, which is movable longitudinally, similarly to the backing member positioner 300. Alternatively, pressure may be applied using another pressing assembly different from the pressing assembly 250.

Afterwards and optionally, the backing members 302 can be removed from the wrapping material 60 by lowering it using the backing member positioner 300 and the wrapped article 22 can be moved further forward to exit the apparatus 20.

In the alternative embodiment wherein adhesive strips extend normal to the adhesive strips shown in FIG. 6, from an inside end thereof and towards a respective longitudinal edge of the wrapping material 60, these second adhesive strips would be superposed to the front adhesive strips 208, superposed to the lateral faces 30, adjacent to the rear face 26, and parallel to the rear lateral edges 34, in the wrapped configuration.

It will be understood that the embodiments described above are only provided as examples and that various other configurations may be considered. For example, instead of being secured to each other using adhesive, the underlying and overlying portions 154*a*, 154*b* could instead be joined together using thermal welding, ultrasonic welding or the like. In this embodiment, a welding tool could be pressed against the overlying portion 154*b* and underlying portion 154*a*, and the backing member 302 would provide the required support for the welding operation.

In the embodiment described above, the front and rear portions of the article 22 are wrapped sequentially. However, in an alternative embodiment, it is appreciated that they could be wrapped simultaneously. In such embodiment, at least some of the components of the wrapping apparatus 20 can be provided in double set, i.e. a first one to wrap the front portion of the article 22 and a second one to wrap the rear portion of the article 22.

Figure 11:
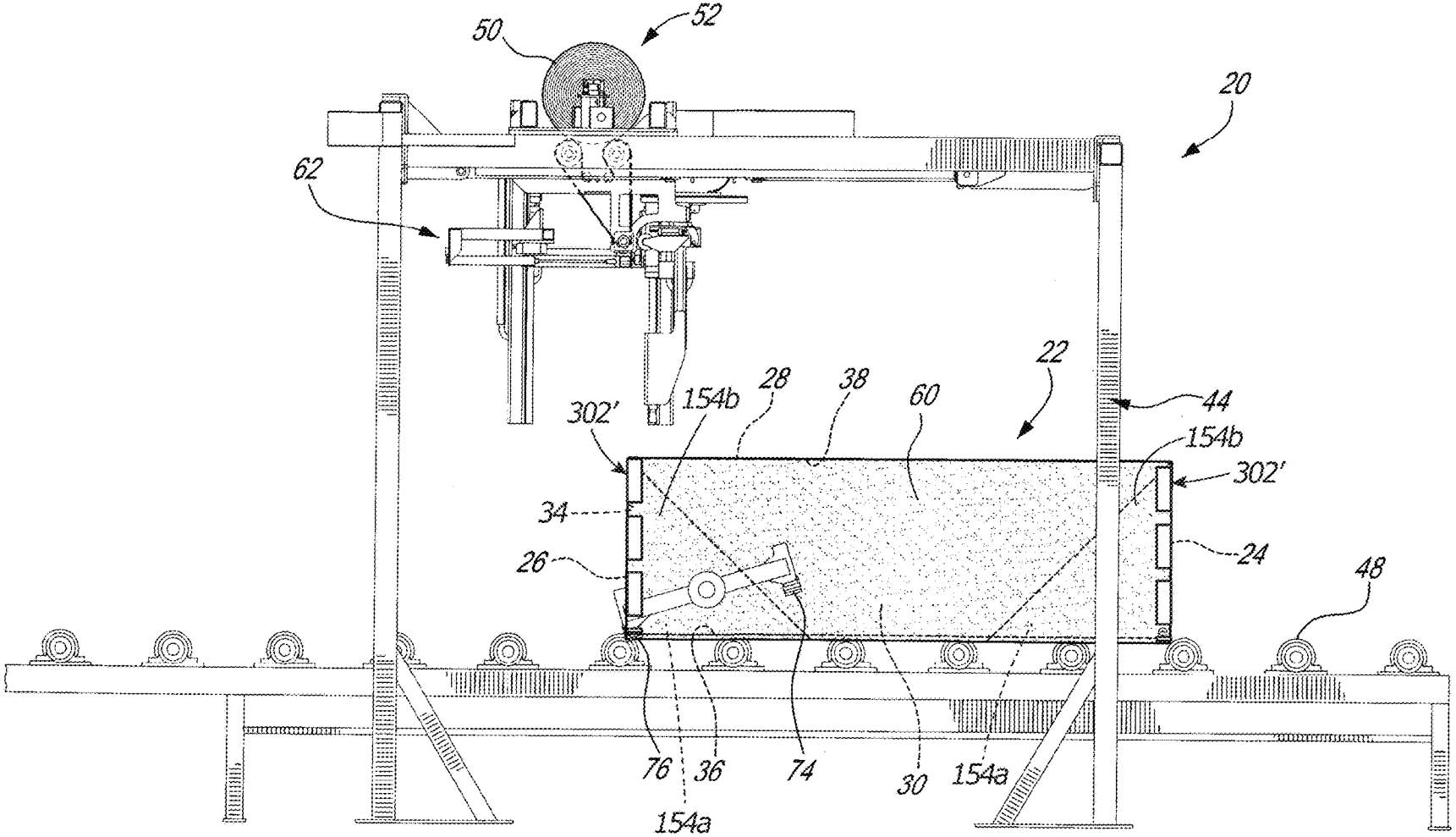
FIG. 11 is a side elevation view of a wrapping apparatus with a wrapped load and a backing member in accordance with one embodiment, in which the backing member is substantially elongated.

FIG. 11 shows another embodiment in which the underlying and overlying portions 154*a*, 154*b* are still fastened to each other using one or more fasteners. In this embodiment, the apparatus 20 therefore may not include an adhesive applicator 500. Instead, the stapling mechanisms 91 could be used to insert one or more fasteners through the wrapper material, such as the underlying and overlying portions 154*a*, 154*b*, and through backing members 302' positioned underneath the underlying portions 154*a*. Specifically, the backing members 302' may be made from a relatively soft and non-brittle material such as wood which could be penetrated by the fasteners 104. Unlike the backing members 302 described above, the backing members 302' can be released from the backing member positioner 300. Specifically, the backing member positioner 300 could be configured to hold the backing members 302' while the backing members 302' are positioned against the lateral faces 30 of the article 22 and could be released once the wrapper material, such as the underlying and overlying portions 154*a*, 154*b* have been secured to the backing members 302'. In this embodiment, the backing member 302' would therefore be integrated into the wrapping of the article 22, along with the wrapping material 60.

In the embodiments described above, the underlying and overlying portions 154*a*, 154*b* are secured to each other, either with bonding, an adhesive or with a fastener extending through the portions 154*a*, 154*b* and through the backing member 302', and the wrapping material 60 is fastened to the article 22 using the first and second fasteners 100, 102, 110, 112.

In some cases, it may not be desirable, practical or possible to fasten the wrapping material 60 directly to the article 22 being wrapped. For example, the article 22 could include fragile and/or brittle material such as drywall panels that staples could damage and/or which may not properly retain staples. In such cases, the wrapper material 60 can be secured to the backing members 302 and/or to itself and the folded wrapper material 60 can be secured to the article 22 using straps surrounding the wrapped article, as further detailed below.

Figure 12:
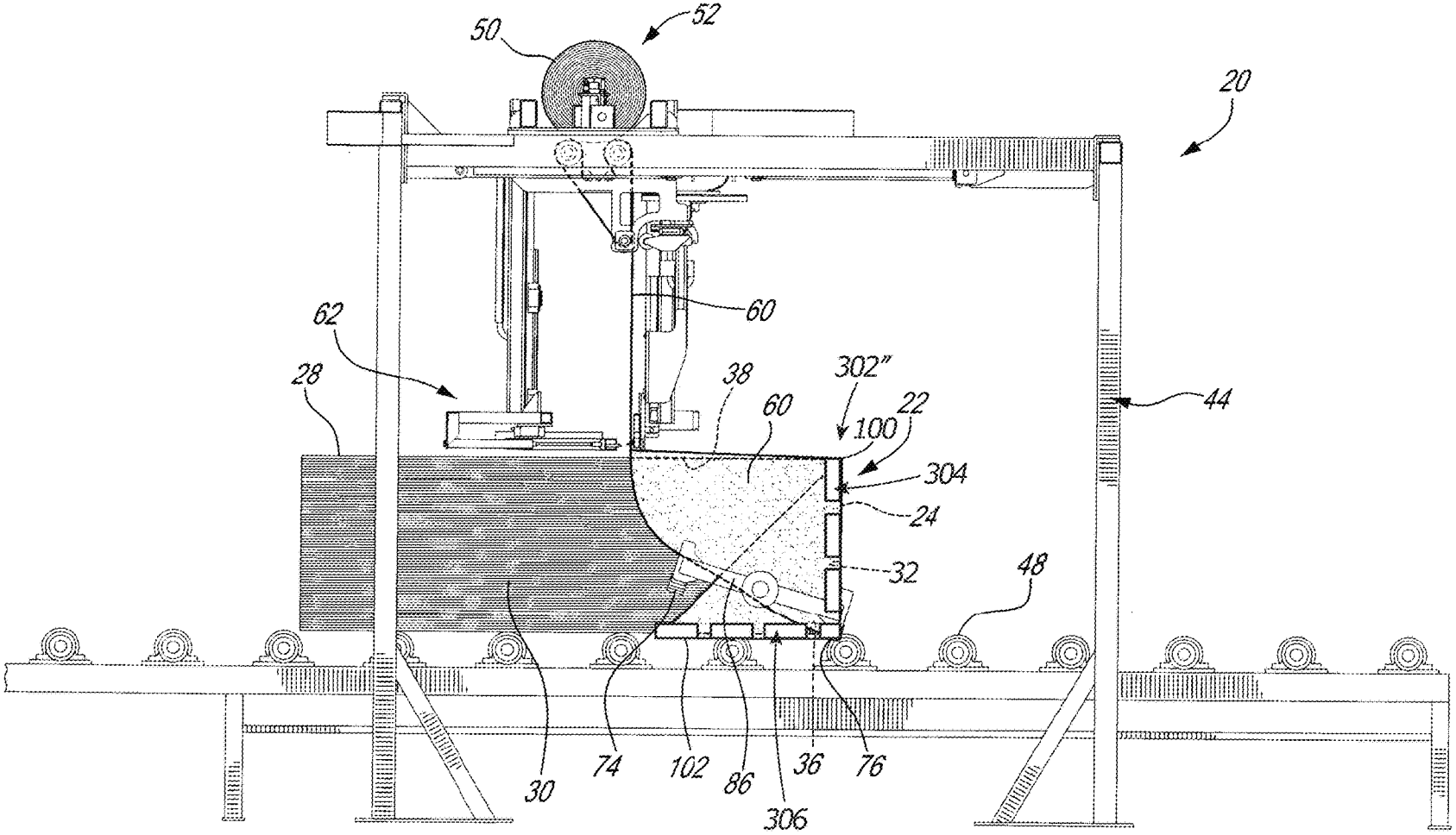
FIG. 12 is a side elevation view of the wrapping apparatus shown in FIG. 11 with a backing member in accordance with another embodiment, in which the backing member is substantially L-shaped.

Turning to FIG. 12, there is shown the wrapping apparatus 20 including a backing member 302", in accordance with another embodiment. The backing member 302" is releasably engaged with the backing member positioner 300, similarly to the backing member 302'. In this embodiment, the backing member 302" is substantially L-shaped and includes first and second backing member segments 304, 306 extending substantially perpendicular to each other. The first backing member segment 304 is substantially positioned along the front lateral edge 32, similarly to the backing member segments 302, 302' described above. In this embodiment, the second backing member segment 306 extends substantially along the lower longitudinal edge 36 of the corresponding lateral face 30 and is sufficiently long to reach the second fastener 102. In this embodiment, both the first and second fasteners 100, 102 would therefore be aligned with the backing member 302" and engage the backing member 302", in addition to the wrapping material 60, instead of the article 22 itself.

In the embodiment illustrated in FIG. 12, the first and second backing member segments 304, 306 are integrally formed together. Alternatively, the first and second backing member segments 304, 306 could instead be provided as distinct components. In another embodiment, the backing member 302" could include more than two segments, and each segment could have any suitable shape and/or configuration.

In this embodiment, the wrapping material 60 may therefore not be fastened at all to the article 22. The wrapped article could further be provided with one or more straps or similar non-destructive tying element that would surround the wrapped article to substantially prevent movement of the wrapping material 60 relative to the article 22.

In another embodiment, instead of being secured by fasteners to the backing member 302", the entire wrapping material 60 could be held in the wrapping configuration only with adhesive. For example, an additional adhesive strip could be formed on the underlying portion 154*b*, substantially along the lower longitudinal edge 36 of the corresponding lateral face 30. In this embodiment, the backing member 302" may not be releasable from the backing member positioner 300 and both first and second backing member segments 304, 306 would be used to provide support for corresponding pressing assemblies applying pressure on the two adhesive strips, similarly to the backing member 302 described above.

In the above-described embodiments, the wrapping material 60 is folded first against the front face 24 of the article 22 and, optionally simultaneously, against the rear face 26 of the article 22, which can be referred to as the first peripheral faces of the article 22 being covered by the wrapper material 60, as explained above. Then, second wrapping sections 150*b* are folded against a respective one of the lateral faces 30 and, then covered by third wrapping sections 150*c*. In an alternative embodiment (not shown), first wrapping sections of the wrapping material can be folded first against the lateral faces 30 of the article 22. In such embodiment, the first wrapping sections corresponds to the third wrapping sections of the embodiment shown in FIG. 3B. Then, the second wrapping sections 150*b* (which are the same as the one shown in FIG. 3B) can be folded against a respective one of the front face 24 and the rear face 26 of the article 22, about the front and the rear lateral edges 32, 34 respectively, forming underlying material web portions. In such embodiment, the backing member 302 are superposed to the front face 24 and the rear face 26 of the article 22, adjacent to a respective one of the front and the rear lateral edges 32, 34. In an embodiment, at least a segment of each one of the backing members 302 extends substantially parallel to a respective and adjacent one of the front and the rear lateral edges 32, 34. The adhesive strip 206, 208 are aligned with a respective one of the backing members 302. The adhesive strips can be applied to the outer surface of the wrapping material 60 and extend substantially normal to the adhesive strips 306 shown in FIG. 3B, in the second wrapping material section 150*b*. More particularly, the adhesive strip from an inner end of the adhesive strips 306, shown in FIG. 3B, but towards a respective one of the longitudinal edges of the wrapping material 60. As for the embodiment described above, the wrapping material 60 can include adhesive strips that extend normal to the adhesive strips extending parallel to the front and the rear lateral edges 32, 34 in the wrapped configuration, from an inside end of these strips and towards a respective transversal edge of the wrapping material 60, i.e. either the front edge of the rear edge of the wrapping material 60, such as the ones shown in FIG. 3B, forming the overlying material web portion(s). Then, a third wrapping material section (which corresponds to the first wrapping section 150*a* of the embodiment shown in FIG. 3B) is folded against the upper transversal edges 40, delimitating the front and the rear faces 24, 26 respectively.

In this embodiment, the first peripheral faces of the article 22 being covered with the wrapper material 60 are the lateral faces 30, which can be covered sequentially or simultaneously. The front and the rear faces 24, 26 of the article 22 are the second peripheral faces of the article 22 being covered with the wrapper material 60.

As for the above-described embodiment, pressure can be applied on the folded wrapper sections against the front and the rear faces 24, 26. Fasteners can be inserted in the wrapping material 60, the backing members 302, and/or the article 22. The backing members 302 can be removed or can remain with the wrapped articles. The front and the rear faces 24, 26 of the article 22 can be wrapped sequentially or simultaneously.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A method for wrapping at least a portion of an article with a wrapper material web in a wrapping station, the method comprising:

superposing at least one backing member to a peripheral face of the article at a desired location along the article, wherein the at least one backing member is covered at least partially by the wrapper material web;

then, securing at least two superposed sections of the wrapper material web together using the at least one backing member as support;

removing the at least one backing member following the securing of the at least two superposed sections of the wrapper material web before withdrawing the article from the wrapping station.

2. The method of claim 1, wherein the at least two superposed sections of the wrapper material web using the at least one backing member as support proximal are secured by applying localized pressure to a section of the wrapper material web covering the at least one backing member in a direction substantially normal to the peripheral face of the article.

3. The method of claim 1, wherein the at least one backing member comprises at least one of an elongated material strip and a L-shaped material strip and wherein superposing the at least one backing member to the peripheral face of the article comprises superposing simultaneously two backing members to a respective one of the peripheral face, adjacent to and substantially along a respective one of lateral edges of the article delimitating the respective one of the peripheral face and further comprising folding the wrapper material web about at least one edge of the article and against the respective peripheral face.

4. The method as claimed in claim 1, further comprising covering at least a portion of the peripheral face of the article having the at least one backing member superposed thereto with the wrapper material web.

5. The method as claimed in claim 4, further comprising applying adhesive to the wrapper material web and wherein covering the at least a portion of the peripheral face of the article having the at least one backing member superposed thereto with the wrapper material web comprises aligning at least partially the adhesive applied to the wrapper material web with the at least one backing member, the method further comprising applying localized pressure to the section of the wrapper material web covering the at least one backing member to bond the adhesive.

6. The method as claimed in claim 5, wherein the adhesive is applied to the section of the wrapper material web covering the at least one backing member and the localized pressure is applied by a pressing assembly for pressing an overlying material web portion against an underlying web portion of the wrapper material web with the adhesive being applied between the overlying and underlying web portions to promote adhesion between the overlying and underlying web portions.

7. The method of claim 1, wherein superposing the at least one backing member to the peripheral face of the article comprises superposing simultaneously two backing members to a respective one of the peripheral face, adjacent to and substantially along a respective one of lateral edges of the article delimitating the respective one of the peripheral face and further comprising folding the wrapper material web about at least one edge of the article and against the respective peripheral face.

* * * * *